United States Patent [19]

Shibata

[11] 4,309,461

[45] Jan. 5, 1982

[54] METHOD OF COMPOUNDING DECORATIVE PRECIOUS METAL ALLOY SELECTIVELY ONTO AUSTENITE STAINLESS STEEL ARTICLE

[75] Inventor: Akira Shibata, Yokohama, Japan

[73] Assignee: Chugai-Duki Kogyo Kabushiki-Kaisha, Japan

[21] Appl. No.: 150,190

[22] Filed: May 15, 1980

[51] Int. Cl.[3] ..... C23B 5/52

[52] U.S. Cl. ..... 427/259; 427/46; 427/261; 427/287; 427/376.8; 204/18.1; 204/37 R

[58] Field of Search ..... 427/383.9, 259, 261, 427/287, 46, 376.8, 282; 204/37 R, 15, 18.1, 466

[56] References Cited

U.S. PATENT DOCUMENTS

| | | | |
|---|---|---|---|
| 1,104,842 | 7/1914 | Smith | 204/37 R |
| 1,906,689 | 5/1933 | Ledig | 204/37 R |
| 3,251,121 | 5/1966 | Prival | 204/37 R |
| 3,698,880 | 10/1972 | Koons et al. | 204/37 R |
| 3,725,219 | 4/1973 | Wesoloski | 204/37 R |

FOREIGN PATENT DOCUMENTS

| | | | |
|---|---|---|---|
| 997287 | 7/1965 | United Kingdom | 204/37 R |

*Primary Examiner*—Ralph S. Kendall

*Attorney, Agent, or Firm*—Shlesinger, Fitzsimmons & Shlesinger

[57] ABSTRACT

Method of preparing metallic compound materials for spectacle frames, watch casings, bracelets for watches and others, necklaces, and other decorative articles, which comprise a base made from austenite stainless steel, and an alloy of precious metals of a desired purity such as gold, platinum, and palladium which is selectively or partially laid over said base steel. Said method comprises masking the base steel at its outer surfaces other than those selected parts which shall be laid over by said precious metal alloy, plating said selected parts with a plurality of layers of metals which constitute said precious metal alloy and which are respectively in volumes correspondent to their constituent percentage ratios of said alloy, removing the masking from the base steel, and subjecting the metal layers on the base steel to such temperature for a short period of time which is sufficient to cause them to be in liquid phase, resulting in binding them onto the base steel as a single alloy layer of one or more precious metals of the desired purity, when they are solidified.

5 Claims, No Drawings

METHOD OF COMPOUNDING DECORATIVE PRECIOUS METAL ALLOY SELECTIVELY ONTO AUSTENITE STAINLESS STEEL ARTICLE

BACKGROUND OF THE INVENTION

Austenite stainless steel which is excellent in its anti-abrasion property and easy to work on, is widely used for spectacle frames, watch casings, watch bracelets, other decorative bracelets, and necklaces. These articles are often laid over selectively at their outer surfaces by an alloy of precious metals of a desired purity such as for example gold 18 carats fine and 14 carats fine, in order to enhance their decorative effects.

Austenite stainless steel materials compounded with an alloy of precious metals such as gold alloy to have an overlay or inlay for example is conventionally produced by so-called separate plating or masking plating method. The separate plating method is not economically suited for continuously processing small dimensional goods such as articles of the above-mentioned kind in an industrially acceptable scale. Hence, the masking method is more conventionally employed, in which those articles are masked at their outer surfaces other than those specific portions where they are to be plated, and the said specific or unmasked portions are electrolytically plated by a desired precious metal alloy. As an other method for compounding austenite stainless steel decorative articles with a gold alloy, they are overlaid or inlaid by binding thereto a thin sheet of gold 18 carats fine for example by means of a silver hard solder.

In the former method, viz., mask-plating method, however, it is hard to effectively compound or plate a surface of the stainless steel base with an even and very dense layer of precious metal alloy of a thickness more than a limited amount of about 1.5$\mu$, because its alloy constituents are differently and unevenly ionized in a single electrolytic solution, and produce cracks or pin holes in the constituents precipitated onto the surface as they alloy. These cracks and pin holes weaken mechanical strength, particularly anti-abrasion property of the decorative alloy tinsel. The latter method, viz., soldering method though which can overlay or inlay a precious metal alloy of any desired thickness onto the basic stainless steel, has also drawbacks that it is extremely laborious and difficult to have a minute piece of thin alloy metal sheet put in place on the steel and overlaid or inlaid firmly thereto by solders, and that the solders which have been employed in cladding the thin sheet piece of alloy to the basic sheet, corrode comparatively soon and decrease sparkling effect given by the decorative alloy to an article.

BRIEF SUMMARY OF THE INVENTION

This invention relates to a method of compounding a precious metal alloy of a desired purity such as gold 18 or 14 carats fine to the selected outer portions of a decorative article made of austenite stainless steel, and more particularly it relates to the method for producing compound metallic materials for such article. The compound metallic materials which are, for example, an elongated strip in the form of a continuous train of such articles, are utilized, when they are cut and re-shaped or finally shaped, as component parts of a spectacle frame, watch casing, watch bracelets, necklace and other decorative metallic articles.

In the present invention method, differently to the aforementioned conventional mask-plating method in which basic metal material is electrolytically plated by a desired precious metal alloy per se by a single plating step, each or a group of constituent metals of a desired precious metal alloy is firstly plated onto the selected parts of a basic metal material independently to each other in an independent electrolytic bath and successively in different baths so as to form a plurality of thin layers of said constituent metals which are precipitated portionally onto said basic austenite stainless steel material in thickness proportionate to the ratios of each constituent metals in the alloy of a desired purity. The basic material thus overlaid or inlaid by a plurality of thin metal layers is then heated for a short period and in a non-oxidizable or hydrogen atmosphere to a temperature sufficient to cause said metal layers to melt and diffuse to each other to form their alloy which is firmly solidified in a desired thickness and in the desired purity such as gold 18 or 14 carats fine on said basic metal material. It shall be noted, as an advantage of this invention, that as constituent metals of an alloy are stepwise plated onto a metallic article successively in diferent electrolytic bath, each baths contains a single metal as anode of direct current passing in the bath and each metals which has been converted to the correspondent metallic salt in the bath naturally bears ions of an equal potential, resulting in their precipitation onto the austenite stainless steel material as cathode in any desired thickness with even, fine, and very dense layers. Thus obtained stainless steel material for decorative component parts of various articles which is a rod-like or strip-like shape for example as a train of such component parts, is rolled or drawn for having its surface finished and shaped, if needed. And, it is cut to a desired piece.

In the method in accordance with this invention, alloys of any precious metal including Au, Pt, and Pd can successfully be compounded to austenite stainless steel article.

Their alloys are represented in the following, but not limited thereto.

Au-Ag-Cu
Au-Ag-Cu-Zn-Sn
Au-Ag-Cd
Au-Ag
Au-Ni-Zn
Au-Cu-Ni-Zn
Au-Cu-Ni
Au-Pt-Ag
Pt-Cu
Au-Pt-Ag-Cu
Pd-Ag
Pd-Cu
Au-Cu-Zn-Cd
Au-Ag-Cu-Zn-Cd
Au-Ag-Cu-Zn
Au-Ag-Cu-Zn-Cd-Sn
Au-Ag-Cu-Ni-Zn
Au-Pt-Pd
Au-Ag-Pd-Cu
Au-Ag-Pd-Cu-Zn
Au-Ag-Pd-Cu-Cd

The above alloys which further contain Co and/or In could be also compounded to the base steel in accordance with this invention method. And, in carrying out the method, the thickness of a layer of a specific constituent metal of the alloy of either one or combination of Au, Pt, and Pd of a desired purity which is to be formed on an article, can easily be determined by the following equation.

$$\text{Said thickness of a specific constituent metal} = \text{Thickness of 20 alloy} \times \frac{\text{Percentage ratio of said metal in alloy}}{100} \times \frac{\text{Specific gravity of alloy}}{\text{Specific gravity of said metal}}$$

A layer of said thickness of one of constituent metals of an alloy of Au, Pt, and/or Pd is readily formed on an article in the present invention method by controlling parameters of electrolytic plating processes. And, it has been found that orders of layers of the constituent metals formed on the article do not give any noticeable difference to the alloy to be made by them.

DETAILED DESCRIPTION

Hereinafter, this invention is described further in detail with reference to the examples in which gold 18 and 14 carats fines are alloyed and compounded onto an article as embodiments of alloys of one or combination of Au, Pt, and Pd.

EXAMPLE 1

An elongated strip of austenite stainless steel (18-8 stainless steel of low carbon containing 17–19% of chrome and 8–10% of nickel) having a semi-circular cross section of a base of 5 mm was treated with hydrofluoric acid to clean its surfaces. Said base and two lateral sides extending from said base for 2 mm each were masked. The steel material thus masked was passed successively through three electrolytic baths, in which said steel was made as cathode, and Ag, Cu, and Au were respectively annodes. Plating salt in the Ag bath was KAg (CN)2, that in the Cu bath CuSO4, and that in the Au bath KAu(CN)2.

When the steel was passed through the AG bath, a silver layer of 4μ was plated to the upper semi-circular exposed surface, and subsequently when it was passed through the Cu bath, said silver layer was plated by a copper layer of 3.13μ. The steel was further plated in the succeeding Au bath by a gold layer of 10.87μ.

Said plating layers are as follows.

Ag layer 4μ (15 weight %)

Cu layer 3.13μ (10 weight %)

Au layer 10.87μ (75 weight %)

The total thickness of the layers was 18μ, and the constituents thereof correspond to a gold 18 carats fine. The mask was removed from the steel. And, then, it was passed through a hydrogen atmosphere for about 4 seconds, in which the steel was heated portionally about said layers to about 970° C. by high frequency induction coils of 40 Kc. The strip steel thus overlaid by a gold 18 carats fine was passed through rollers so that its cross-section had been shaped to the one exactly correspondent to that of desired blocks for a watch bracelet. This shaping process worked also to finely polish the surface of said overlay and exposed steel part.

When said steel was cut to a desired length transversely to its longitudinal direction, pieces of the blocks were produced.

EXAMPLE 2

The steps same to Example 1 were repeated, except that the plating processes were controlled so that the three layers could have the following thicknesses.

Ag layer 2.5μ (20.84%)

Cu layer 3.0μ (20.83%)

Au layer 3.8μ (58.33%)

These total thickness is 9.3μ, and its constituents are equivalent to a gold 14 carats fine. The heating of these layers to have them alloy was made by heating them to about 850° C. for about 3 seconds by high frequency induction coils of 40 Kc, in an atmosphere of argon.

The steel strips obtained in Examples 1 and 2 were subjected to tests of (1) twisting 180° for four times, (2) bending 90° with the plated surfaces up, and (3) immersing into synthetic sweat for 7 days at a room temperature. Results of the tests (1) and (2) showed no physical change of the strips, and the test (3) gave no rust.

What is claimed is:

1. A method of overlaying an austenite stainless steel material for decorative articles and ornaments with an alloy of Au, Pt, and/or Pd bases, which comprises plating selected surfaces of the steel material with the constituents of said alloy in any desired order, and one at a time in a plurality of successive layers, and with each layer being of a thickness and volume which corresponds to the constituent ratios of the alloy of a desired purity and dimension, and heating the layers to a temperature sufficient to cause them to liquid phase alloy.

2. The method as claimed in claim 1, including masking the steel material at its outer surfaces in those areas other than those to be plated prior to the plating steps, and removing the masking prior to heating said layers.

3. The method as claimed in claim 1, in which the alloy is selected from the class consisting of Au-Ag-Cu, Au-Ag-Cu-Zn-Sn, Au-Ag-Cd, Au-Ag, Au-Ni-Zn, Au-Cu-Ni-Zn, Au-Cu-Ni, Au-Pt-Ag, Pt-Cu, Au-Pt-Ag-Cu, Pd-Ag, Pd-Cu, Au-Cu-Zn-Cd, Au-Ag-Cu-Zn-Cd, Au-Ag-Cu-Zn, Au-Ag-Cu-Zn-Cd-Sn, Au-Ag-Cu-Ni-Zn, Au-Pt-Pd, Au-Ag-Pd-Cu, Au-Ag-Pd-Cu-Zn, and Au-Ag-Pd-Cu-Cd.

4. The method as defined in claim 3, wherein said alloy includes Co and/or In.

5. The method as defined in claim 1, wherein the thickness of layer of a respective constituent metal (Tc) is determined by the formula $$Tc = Ta\left(\frac{R}{100}\right)\frac{SG_a}{SG_c}$$

where Ta is the thickness of the alloy; R is the percentage ratio of the constituent metal in the alloy; $SG_a$ and $SG_c$ are the specific gravities of the alloy and the constituent metal, respectively.

* * * * *